US006908896B2

(12) United States Patent
Bauer et al.

(10) Patent No.: US 6,908,896 B2
(45) Date of Patent: Jun. 21, 2005

(54) BUILDER COMPOSITION PREPARED BY HEAT-TREATING A CRYSTALLINE LAYERED NA SILICATE

(75) Inventors: Harald Bauer, Kerpen (DE); Josef Holz, Erftstadt (DE); Günther Schimmel, Erftstadt (DE)

(73) Assignee: Clariant GmbH, Frankfurt (DE)

( * ) Notice: Subject to any disclaimer, the term of this patent is extended or adjusted under 35 U.S.C. 154(b) by 420 days.

(21) Appl. No.: 10/123,796

(22) Filed: Apr. 16, 2002

(65) Prior Publication Data

US 2003/0073605 A1 Apr. 17, 2003

(30) Foreign Application Priority Data

Apr. 28, 2001 (DE) ..... 101 21 051

(51) Int. Cl.[7] ..... C11D 3/08
(52) U.S. Cl. ..... 510/511; 510/531
(58) Field of Search ..... 510/511, 531

(56) References Cited

U.S. PATENT DOCUMENTS

| | | | | | |
|---|---|---|---|---|---|
| 4,664,839 | A | | 5/1987 | Rieck | |
| 5,456,895 | A | * | 10/1995 | Tapper et al. | 423/332 |
| 5,520,860 | A | * | 5/1996 | Tapper et al. | 264/15 |
| 6,284,722 | B1 | * | 9/2001 | Yamaguchi et al. | 510/357 |
| 6,300,303 | B1 | * | 10/2001 | Bauer et al. | 510/466 |
| 6,372,709 | B1 | | 4/2002 | Bauer et al. | 510/511 |
| 6,506,722 | B1 | * | 1/2003 | Bauer et al. | 510/511 |
| 6,521,585 | B1 | * | 2/2003 | Yamashita et al. | 510/444 |
| 2001/0009897 | A1 | * | 7/2001 | Bauer et al. | 510/511 |
| 2002/0155982 | A1 | | 10/2002 | Bauer et al. | 510/511 |

FOREIGN PATENT DOCUMENTS

| | | | |
|---|---|---|---|
| CA | 2226071 | * | 6/1998 |
| DE | 199 13 995 | | 10/2000 |
| EP | 0 164 514 | | 12/1985 |
| EP | 0 650 926 | | 5/1995 |
| EP | 0 849 355 | | 6/1998 |
| EP | 0 928 827 | | 7/1999 |
| EP | 0 970 918 | | 1/2000 |
| EP | 1 113 068 | | 7/2001 |
| EP | 1 205 537 | | 5/2002 |
| WO | 90/13533 | | 11/1990 |
| WO | 98/23531 | | 6/1998 |
| WO | 00/36061 | | 6/2000 |

OTHER PUBLICATIONS

English abstract for WO 90/13533, Nov. 15, 1990.

English abstract for WO 00/36061, Jun. 22, 2000.

English abstract for DE 19913995, Oct. 5, 2000.

English abstract for JP 58–217598, Dec. 17, 1983.

U.S. Appl. No. 10/039,480, filed Nov. 9, 2001, Bauer, et al.

* cited by examiner

*Primary Examiner*—Charles Boyer
(74) *Attorney, Agent, or Firm*—Richard P. Silverman

(57) ABSTRACT

The invention relates to builder compositions with improved dissolution residue behavior, obtained by bringing a) crystalline layered sodium silicate of the formula $NaMSi_xO_{2x+1}*yH_2O$, where M is sodium or hydrogen, x is a number from 1.9 to 4 and y is a number from 0 to 20, and b) water or an aqueous solution or dispersion of at least one detergent ingredient, c) where the molar ratio of component a) to the water from component b) is 0.5:1 to 20:1, into contact with one another and subsequently heat-treating the resulting builder composition at 30 to 400° C. for 0.5 to 1000 min.

39 Claims, No Drawings

BUILDER COMPOSITION PREPARED BY HEAT-TREATING A CRYSTALLINE LAYERED NA SILICATE

The invention relates to builder compositions with improved dissolution residue behavior, obtainable by bringing crystalline layered sodium disilicate and water into contact, and subsequently heat-treating the resulting builder compositions.

The drive toward saving energy during washing and cleaning processes, e.g. in the case of the machine washing of textiles and dishwashing, demands an ever greater reduction in the water consumption. Laundry detergents and cleaners which are based on water-insoluble builder systems such as zeolite or partially soluble systems such as crystalline layered sodium disilicate thus increasingly reach the limit of their capability. A negative consequence of reducing the water consumption which is observed is, for example in the case of the washing of textiles—particularly in the case of dark colored textiles—white residues on the fabrics which originate from undissolved or poorly dispersed builder.

An object of the present invention was to provide builder composition with improved dissolution residue behavior.

EP 0 650 926 describes the roll compaction of crystalline layered sodium disilicate by roll compaction with the addition of hardening agents such as water, silica sol, silica gel, surfactants, waterglass, maleic acid-acrylic acid polymers and other copolymers. The aim of the preparation is a granulate resistant to mechanical wear. The granulation itself takes place at 15 to 130°C. The compaction material is not preheated since the temperature is achieved on its own as a result of the mechanical rubbing between the compaction material and the compacting rolls. The residence time of the compaction material in the roll compacter, the formation of flakes and the comminution to give the granulate ranges overall in the range from fractions of a second to a few seconds.

Surprisingly, it has now been found that builder compositions based on crystalline layered sodium silicate which are obtainable by bringing crystalline layered sodium silicate into contact with water or aqueous solutions of detergent ingredients in a certain ratio with one another and subsequently heat-treating the resulting builder compositions exhibit improved dissolution residue behavior.

Accordingly, the invention provides a builder composition obtainable by bringing a) crystalline layered sodium silicate of the formula $NaMSi_xO_{2x+1}$* $yH_2O$, where M is sodium or hydrogen, x is a number from 1.9 to 4 and y is a number from 0 to 20, and b) water or an aqueous solution or dispersion of at least one detergent ingredient, c) where the molar ratio of component a) to the water from component b) is 0.5:1 to 20:1, into contact with one another and subsequently heat-treating the resulting builder composition at 30 to 400° C. for 0.5 to 1000 min.

The sodium silicates a) are preferably those with x values of 2, 3 or 4. Particular preference is given to sodium disilicates $Na_2Si_2O_5$*$yH_2O$ where x is 2. The sodium silicates a) may also be mixtures.

Crystalline layered sodium disilicate a) is composed of alternating percentages of the polymorphous phases alpha, beta, delta and epsilon. In commercial products amorphous fractions may also be present. As a result of the latter, x in commercial products may also be an uneven number. Preferably, $1.9 \leqq x \geqq 2.2$.

Preferred crystalline layered sodium silicates a) comprise 0 to 40% by weight of alpha-sodium disilicate, 0 to 40% by weight of beta-sodium disilicate, 40 to 100% by weight of delta-sodium disilicate and 0 to 40% by weight of amorphous fractions.

Particularly preferred crystalline layered sodium silicates a) comprise 7 to

21% by weight of alpha-sodium disilicate, 0 to 12% by weight of beta-sodium disilicate, 65 to 95% by weight of delta-sodium disilicate and 0 to 20% by weight of amorphous fractions.

Particular preference is given to crystalline layered sodium silicates a) with a content of 80 to 100% by weight of delta-sodium disilicate.

In a further preferred embodiment, crystalline layered sodium silicates a) with a content of from 70 to 100% by weight of beta-sodium disilicate can also be used.

The abovementioned alpha-sodium disilicate corresponds to the Na SKS-5 described in EP-B-0 164 514, characterized by the X-ray diffraction data reproduced therein which are assigned to the alpha-$Na_2Si_2O_5$ whose X-ray diffraction patterns are registered with the Joint Commitee of Powder Diffraction Standards under the numbers 18-1241, 22-1397, 22-1397A, 19-1233, 19-1234 and 19-1237.

The abovementioned beta-sodium disilicate corresponds to the Na SKS-7 described in EP-B-0 164 514, characterized by the X-ray diffraction data reproduced therein which are assigned to the beta-$Na_2Si_2O_5$, whose X-ray diffraction patterns are registered with the Joint Commitee of Powder Diffraction Standards under the numbers 24-1123 and 29-1261.

The abovementioned delta-sodium disilicate corresponds to the Na SKS-6 described in EP-B-0 164 514, characterized by the X-ray diffraction data reproduced therein which are assigned to the delta-$Na_2Si_2O_5$, whose X-ray diffraction patterns are registered with the Joint Commitee of Powder Diffraction Standards under the number 22-1396.

In a particular embodiment, the crystalline layered sodium silicates a) additionally comprise cationic and/or anionic constituents.

The cationic constituents are preferably alkali metal ions and/or alkaline earth metal cations and/or Fe, W, Mo, Ta, Pb, Al, Zn, Ti, V, Cr, Mn, Co and/or Ni.

The anionic constituents are preferably aluminates, sulfates, fluorides, chlorides, bromides, iodides, carbonates, hydrogencarbonates, nitrates, oxidehydrates, phosphates and/or borates.

In a particular embodiment, the crystalline layered sodium silicates a) comprise up to 10 mol % of boron, based on the total content of $SiO_2$.

In a further preferred embodiment, the crystalline layered sodium silicates a) comprise up to 20 mol % of phosphorus, based on the total content of $SiO_2$.

The crystalline layered sodium silicate a) is preferably used as powder with an average particle size of from 0.1 to 4000 $\mu$m, particularly preferably 10 to 500 $\mu$m, especially preferably 20 to 200 $\mu$m.

Examples of water which are suitable for component b) are tap water, water of condensation (condensate), water vapor, demineralized water, process water (provided contamination is not too severe) etc.

Commercial crystalline layered sodium silicate a) can comprise small amounts of water as a result of production and storage. Because of the low concentration of water and the lack of heat treatment, however, no improvement in the dissolution residue behavior is observed under these circumstances.

The water can also be used in the form of aqueous solutions or dispersions of laundry detergent ingredients. Suitable laundry detergent ingredients are all customary detergent ingredients and mixtures thereof. Secondary advantages can advantageously be achieved through the use of such solutions or dispersions. Thus, in the case of aqueous solutions of alkali metal silicates, polyethylene glycols and long-chain alkyl ethoxylates, hardening of the granulate can additionally be achieved; in the case of dyes, a coloring of the granulate.

Suitable laundry detergent ingredients c) are preferably the substances described later in connection with the laundry detergents and cleaners comprising the builder composition.

Particularly preferred laundry detergent ingredients c) are alkali metal silicates, nonionic surfactants, anionic surfactants, cationic surfactants, polycarboxylate polymers, polycarboxylate copolymers, polyethylene glycols, bentonites, hectorites, saponites and/or dyes.

Preferred alkali metal silicates are sodium and potassium silicates. Their aqueous solutions are also referred to as waterglasses. Such waterglasses are produced by dissolving solid waterglasses (crushed waterglasses), spray-dried waterglasses or directly by hydrothermal digestion of sand and sodium hydroxide solution. The waterglasses preferably have a molar composition of $Me_2O:SiO_2$ equal to 0.2:1 to 1:1 where Me=Na and/or K and $H_2O:SiO_2$ equal to 0.9:1 to 250:1.

The nonionic surfactants are preferably alkyl alkoxylates, gluconamides, alkyl polyglycosides and/or amine oxides. Particularly preferred nonionic surfactants are those described later in connection with the laundry detergents and cleaners comprising the builder composition.

Preferred anionic surfactants are carboxylates, sulfonates and sulfates, particularly preferably ($C_9$–$C_{13}$)-alkylbenzenesulfonates, alpha-olefinsulfonates, alkanesulfonates, esters of sulfo fatty acids, disalts of alpha-sulfofatty acids, sulfuric monoesters of ($C_{12}$–$C_{18}$)-fatty alcohols and soaps. Particularly preferred anionic surfactants are those described later in connection with the laundry detergents and cleaners comprising the builder composition.

Preferred polycarboxylate polymers and copolymers are copolymers of acrylic acid and maleic anhydride or alkali metal salts thereof, preferably the sodium and potassium salts. The molecular weight of the homopolymers is preferably in the range from 1000 to 100 000 g/mol. The molecular weight of the copolymers is preferably in the range from 2000 to 200 000 g/mol, particularly preferably 50 000 to 120 000 g/mol.

Particular preference is given to acrylic acid/maleic acid copolymers with a molecular weight of from 50 000 to 100 000 g/mol.

Preference is also given to copolymers of acrylic acid or methacrylic acid with vinyl ethers, such as, for example, vinyl methyl ether, vinyl esters, ethylene, propylene and styrene. Examples of commercially available products are ®Sokalan CP 5 and PA 30 from BASF, ®Alcosperse 175 or 177 from Alco and LMW 45 N and SPO2 N from Norsohaas.

Preferred cationic surfactants are quaternary ($C_6$–$C_{16}$)—N—, preferably ($C_6$–$C_{10}$)—N—, alkyl- and alkenylammonium compounds in which the remaining N-positions have been substituted by methyl, hydroxyethyl and/or hydroxypropyl groups. Particularly preferred cationic surfactants are those described later in connection with the laundry detergents and cleaners comprising the builder composition.

Preferred polyethylene glycols are those with a molecular weight of from 1000 to 10 000 g/mol, particularly preferably 2000 to 8000 g/mol.

Preferred bentonites, hectorites and saponites are montmorillonites with the formula $Na_x[Al_{4-x}Mg_x(OH)Si_4O_{10}]*nH_2O$ where $0.1 \leqq x \leqq 0.4$ and $0 \leqq n \leqq 20$, preferably x is about 0.33 and n is about 4, hectorites with the formula $Na_x[Mg_{3-x}Li_xSi_4O_{10}]*nH_2O$ where $0.1 \leqq x \leqq 0.4$ and $0 \leqq n \leqq 20$ and saponites with the formula $Na_x[Mg_3(Si_{4-x}Al_x)_4O_{10}]*nH_2O$ where $0.1 \leqq x \leqq 0.4$ and $0 \leqq n \leqq 20$, preferably x is about 0.33 and n is about 1. The bentonites, hectorites and saponites are usually used as aqueous dispersions.

Preferred dyes are oxidation-stable dyes and/or pigments, particularly preferably the ®Sandolan grades (S. Blue E-HRL 180, S. NBG 125 (brilliant red), S. MFBL (green)) and also ®Vitasin grades (V. ponceau 4RC82 (red), V. chinolingelb 70 (yellow) and ®Telon grades (Telon Blau AFN, DyStar Textilfarben). It is also possible to use pigments such as ®Patentblau (DyStar), ®Unisperse grades or ®Terasil-T grades (both Ciba). The dyes can also be used as solutions or dispersions.

The concentration of the respective laundry detergent ingredients in the aqueous solutions or dispersions is also governed by handlability (pumpability, flowability, storage stability etc.) of the corresponding solution or dispersion. Within the limits of the ratio c) of crystalline layered sodium silicate a) to the water from component b) according to the invention, any desired concentrations are possible.

The weight ratio of crystalline layered sodium silicate a) to the detergent ingredients is preferably 5:1 to 1000:1, particularly preferably 7:1 to 200: 1, especially preferably 10:1 to 100:1.

The observance of the molar ratio c) of the crystalline layered sodium silicate a) to the water from component b) is of essential importance for the invention. The molar ratio c) of the crystalline layered sodium silicate a) to the water from component b) is preferably 1:1 to 20:1, particularly preferably 1:1 to 10:1 and especially preferably 1.2:1 to 5:1.

Components a) and b) can be brought into contact by all processes which ensure adequate contact of the components. Preference is given to mixing, spurting and spraying techniques, particular preference being given to mixing techniques. Preferred mixers are paddle mixers, annular layer mixers or plowshare mixers, e.g. from Lödige, free-falling mixers, e.g. from Telschig, Eirich mixers, Schugi mixers, fluidized-bed mixers and drum mixers. The mixing times are preferably 0.5 s to 60 min, particularly preferably 2 s to 15 min.

When bringing components a) and b) into contact, all variants are conceivable which ensure adequate mixing of the components. Thus, for example, fractions of the components may be premixed and the remainders mixed in subsequently.

Component b) can also be brought into contact in the gaseous, vapor or aerosol-like state with the crystalline layered sodium silicate a).

Components a) and b) can be brought into contact at ambient temperature, but also at elevated temperature. Preference is given to temperatures of from 0 to 300° C., particularly preferably 10 to 200° C.

The heat can be introduced by external heating. If necessary all of the components, or only some of them, can be preheated.

An essential feature of the invention is the subsequent heat treatment of the builder composition, which leads to a significant improvement in the dissolution residue behavior. In this connection, the invention is to be understood as meaning that the heat treatment is carried out after components a) and b) have been brought into contact, but does not have to be the immediately subsequent process step.

The heat treatment is preferably carried out at temperatures between 40 and 300° C., particularly preferably 60 to 200° C., especially preferably 70 to 150° C.

The duration of the heat treatment is preferably 2 to 1000 min, particularly preferably 2 to 120 min, especially preferably 10 to 120 min.

The water vapor partial pressure during the heat treatment is preferably 10 mbar to 10 bar, particularly preferably 250 mbar to 3 bar.

Preferred apparatuses for the heat treatment are fluidized beds, belt and tunnel furnaces, fly conveyors and storage containers.

It has proven advantageous to keep the builder composition in motion during the heat treatment, as a result of which the homogeneity and transportability during warm storage is better retained.

Preferred apparatuses for this purpose are paddle mixers, annular layer mixers or plowshare mixers, e.g. from Lödige, free-falling mixers, e.g. from Telschig, Eirich mixers, Nauta mixers and drum mixers.

In a preferred embodiment of the invention the bringing into contact and the heat treatment of the builder composition are carried out in separate apparatuses. This can be carried out batchwise discontinuously or preferably continuously. In a further embodiment the bringing into contact and the heat treatment are carried out in one apparatus, continuous operation also being possible.

In a preferred embodiment, the builder composition obtained after bringing components a) and b) into contact is further treated mechanically. Preferred mechanical further treatments are compaction, granulation, grinding, comminution and/or size fractionation.

In this connection, it may expressly be mentioned that the mechanical further treatment can take place as a whole or in partial steps before and after the heat treatment. Multiple heat treatments at various process stages are likewise within the meaning of the invention.

In a preferred embodiment, the components a) and b) are firstly brought into contact, then heat-treated and finally further treated mechanically.

Particularly preferably, the components are firstly brought into contact, then heat-treated, then compacted, then ground/comminuted and finally size-fractionated.

Likewise particularly preferably the components are firstly brought into contact, then heat-treated, then ground and finally size-fractionated.

In a further preferred embodiment the components a) and b) are firstly brought into contact, then further treated mechanically and finally heat-treated.

Particularly preferably, the components are firstly brought into contact, then compacted, then ground, then size-fractionated and finally heat-treated.

Likewise within the meaning of the invention are embodiments in which components a) and b) are brought into contact with one another, then are mechanically treated, then are heat-treated and then are mechanically treated again.

Compaction serves to increase the particle size (particle structure). It differs in two respects from agglomeration. In compaction a binder does not necessarily have to be used, although for agglomeration it is obligatory. Furthermore, the acting compression force not only presses together the powder to be compacted and interlocks the particles, but powder particles are also mutually squashed.

Compaction is preferably compression granulation, such as, for example, roll compaction or briquetting, particularly preferably roll compaction.

The temperature of the material during compaction is preferably between 10 and 200° C., the desired temperature being controlled by external heating/cooling or being self-adjusting as a result of the liberated frictional heat. During compaction, the residence time under pressure is only a few fractions of a second before the resulting flakes are comminuted with mills of an appropriate type and optionally size-fractionated. The heating period is thus much shorter than in the targeted heat treatment according to the invention and is thus too short to improve the dissolution residue behavior.

In a continuous procedure, the flakes produced in the roll compaction are comminuted directly afterwards using mills of an appropriate type and optionally size-fractionated. The acceptable-size material is removed from the particle fractionation, and undersize material and oversize material are returned to the compactor or to the mills, respectively, in the sense of recycle streams. In the case of such continuous process procedure too, the heating period is much shorter than in the case of the targeted heat treatment. Roll compaction is preferably carried out with a linear compression force of from 2 to 200 kN/cm of roll width, particularly preferably 10 to 160 kN/cm of roll width, and at a temperature of from 20 to 200° C. Such information is useful inasmuch as the area onto which the material is actually subjected to the pressure during roll compaction can only usually be defined with difficulty. The greatest pressure acts in the region in which the two concave surfaces of the rolls come closest. This area can only be estimated. In addition, as a result of material wear, the surface of the rolls may be eroded, meaning that uniform pressure distribution is not ensured. If a supporting width of 1 cm is taken as a basis for the abovementioned preferred ranges, then compression forces between 2 and 200 $kN/cm^2$ result, particularly preferably between 10 and 100 $kN/cm^2$. Examples of suitable roll compactors are those from Hosokawa-Bepex and Alexanderwerk.

Grinding serves to decrease the particle size of powders, of compressed granulates and to comminute flakes. For the grinding, preference is given to oscillatory mills, ball mills, roller mills and pendulum roller mills (e.g. those from Neuman & Esser), hammer mills, impact mills or air jet mills (e.g. those from Hosokawa-Alpine).

The size fractionation classifies the ground material into oversize material, acceptable-size material and undersize material, preferably by sifting and/or screening. Particular preference is given to screening. Examples of suitable screens are those from Rhewum, Locker or Allgeier.

The builder composition according to the invention is preferably a powder with an average particle size of from 0.1 to 4000 $\mu$m, particularly preferably 10 to 500 $\mu$m, especially preferably 20 to 200 $\mu$m.

In a further preferred embodiment, the builder composition according to the invention is a granulate with an average particle size of from 200 to 2000 $\mu$m, preferably 400 to 900 $\mu$m.

The builder composition according to the invention is likewise preferably a ground granulate with an average particle size of from 0.1 to 300 $\mu$m, preferably 10 to 200 $\mu$m.

The builder compositions according to the invention are preferably notable for the fact that the dissolution residue of an aqueous 0.25% by weight solution at 20° C. and after stirring for 20 minutes is less than or equal to 50%, preferably less than or equal to 30%.

The invention also provides laundry detergents and cleaners comprising at least one builder composition according to the invention.

The laundry detergents are preferably heavy-duty detergents, compact heavy-duty detergents, compact color detergents, heavy-duty detergents of low bulk density, special detergents, such as, for example, stain removal salts, bleach boosters, drape detergents, wool detergents, modular detergents and institutional detergents.

The cleaners are preferably machine dishwashing cleaners and machine dishwashing detergents. Silicates are primarily in demand here because of their good soil dispersion, their high alkalinity and because of their protective effect for glass. Damage to glass is understood here as meaning both the formation of layered deposits on glassware and also the erosion of the surface of the glass—both leads to the known undesired clouding of glassware.

Preferred laundry detergents and cleaners comprise a) 0.5 to 99% by weight of the builder composition according to the invention b) optionally 0.5 to 80% by weight, preferably 5 to 50% by weight, of cobuilders c) optionally 1 to 50% by weight, preferably 2 to 30% by weight, of interface-active substances d) optionally 1 to 70% by weight, preferably 5 to 50%, of bleaching systems e) optionally 0.5 to 80% by weight, preferably 5 to 50% by weight, of pH regulators f) ad 100% by weight of further customary ingredients.

Particularly preferred laundry detergents and cleaners comprise a) 0.5 to 99% by weight of the builder composition according to the invention b) 0.5 to 80% by weight, preferably 5 to 50% by weight, of cobuilders c) optionally 1 to 50% by weight, preferably 2 to 30% by weight, of interface-active substances, d) optionally 1 to 70% by weight, preferably 5 to 50% by weight, of bleaching systems e) optionally 0.5 to 80% by weight, preferably 5 to 50% by weight, of pH regulators f) ad 100% by weight of further customary ingredients.

In addition, particularly preferred laundry detergents and cleaners comprise a) 0.5 to 99% by weight of the builder composition according to the invention c) 1 to 50% by weight, preferably 2 to 30% by weight, of interface-active substances b) optionally 0.5 to 80% by weight, preferably 5 to 50% by weight, of cobuilders d) optionally 1 to 70% by weight, preferably 5 to 50% by weight, of bleaching systems e) optionally 0.5 to 80% by weight, preferably 5 to 50% by weight, of pH regulators f) ad 100% by weight of further customary ingredients.

In addition, particularly preferred laundry detergents and cleaners comprise a) 0.5 to 99% by weight of the builder composition according to the invention d) 1 to 70% by weight, preferably 5 to 50% by weight, of bleaching systems b) optionally 0.5 to 80% by weight, preferably 5 to 50% by weight, of cobuilders c) optionally 1 to 50% by weight, preferably 2 to 30% by weight, of interface-active substances e) optionally 0.5 to 80% by weight, preferably 5 to 50% by weight, of pH regulators f) ad 100% by weight of further customary ingredients.

In addition, particularly preferred laundry detergents and cleaners comprise a) 0.5 to 99% by weight of the builder composition according to the invention e) 0.5 to 80% by weight, preferably 5 to 50% by weight, of pH regulators b) optionally 0.5 to 80% by weight, preferably 5 to 50% by weight, of cobuilders c) optionally 1 to 50% by weight, preferably 2 to 30% by weight, of interface-active substances d) optionally 1 to 70% by weight, preferably 5 to 50% by weight, of bleaching systems f) ad 100% by weight of further customary ingredients.

In addition, particularly preferred laundry detergents and cleaners comprise a) 0.5 to 98.5% by weight of the builder composition according to the invention b) 0.5 to 80% by weight, preferably 5 to 50% by weight, of cobuilders c) 1 to 50% by weight, preferably 2 to 30% by weight, of interface-active substances, d) optionally 1 to 70% by weight, preferably 5 to 50% by weight, of bleaching systems e) optionally 0.5 to 80% by weight, preferably 5 to 50% by weight, of pH regulators f) ad 100% by weight of further customary ingredients.

In addition, particularly preferred laundry detergents and cleaners comprise a) 0.5 to 97.5% by weight of the builder composition according to the invention b) 0.5 to 80% by weight, preferably 5 to 50% by weight, of cobuilders c) 1 to 50% by weight, preferably 2 to 30% by weight, of interface-active substances, d) 1 to 70% by weight, preferably 5 to 50% by weight, of bleaching systems e) optionally 0.5 to 80% by weight, preferably 5 to 50% by weight, of pH regulators f) ad 100% by weight of further customary ingredients.

In addition, particularly preferred laundry detergents and cleaners comprise a) 0.5 to 97% by weight of the builder composition according to the invention b) 0.5 to 80% by weight, preferably 5 to 50% by weight, of cobuilders c) 1 to 50% by weight, preferably 2 to 30% by weight, of interface-active substances, d) 1 to 70% by weight, preferably 5 to 50% by weight, of bleaching systems e) 0.5 to 80% by weight, preferably 5 to 50% by weight, of pH regulators f) ad 100% by weight of further customary ingredients.

Specific laundry detergents and cleaners comprise 1 to 50% by weight of the builder composition according to the invention, e.g. heavy-duty detergents, color detergents, water softeners and stain removal salts, or 60 to 100% by weight thereof, e.g. modular detergent systems.

Other specific laundry detergents and cleaners, e.g. machine dishwashing cleaners, comprise 0.5 to 30% by weight of the builder composition according to the invention.

The cobuilders are preferably crystalline aluminosilicates, mono-, oligo- or polymeric or copolymeric carboxylic acids, alkali metal ortho-, alkali metal pyro- and alkali metal polyphosphates, crystalline phyllosilicates, crystalline alkali metal silicates without layer structure and/or X-ray amorphous alkali metal silicates.

The bleaching systems are preferably active chlorine carriers and/or organic or inorganic active oxygen carriers (e.g. perborates, percarbonates, percarboxylic acids, etc.), bleach activators (e.g. TAED), bleach catalysts (e.g. in accordance with DE19913995, WO9823531, WO0036061), enzymes for removing discolorations etc.

The interface-active substances are preferably anionic, cationic, nonionic and/or zwitterionic surfactants.

Particularly preferred nonionic surfactants are alkyl alkoxylates, alkyl ester alkoxylates, gluconamides and/or alkyl polyglycosides.

Of the alkyl alkoxylates, preference is given to using ethoxylated alcohols, preferably primary alcohols, having, preferably, 8 to 22 carbon atoms and preferably 1 to 80 EO units per mole of alcohol, where the alcohol radical is linear or, preferably, methyl-branched in the 2 position, or contains a mixture of linear and methyl-branched radicals, as is usually the case in oxo alcohol radicals. Preferred ethoxylated alcohols include, for example, $C_{11}$-alcohols with 3, 5, 7, 8 and 11 EO units, ($C_{12}$–$C_{15}$)-alcohols with 3, 6, 7, 8, 10 and 13 EO units, ($C_{14}$–$C_{15}$)-alcohols with 4, 7 and 8 EO units, ($C_{16}$–$C_{18}$)-alcohols with 8, 11,15, 20, 25, 50 and 80 EO units and mixtures thereof. The given degrees of ethoxylation are statistical average values which may be an integer or a fraction for a specific product. In addition to these, it is also possible to use fatty alcohol EO/PO adducts, such as, for example, the ®Genapol grades 3970, 2909 and 2822 from Clariant GmbH.

Further suitable surfactants are polyhydroxy fatty acid amides of the formula $R_2CO—N(R_3)—Z$ in which $R_2CO$ is an aliphatic acyl radical having 6 to 22 carbon atoms, $R_3$ is hydrogen, an alkyl or hydroxyalkyl radical having 1 to 4 carbon atoms and Z is a linear or branched polyhydroxyalkyl radical having 3 to 10 carbon atoms and 3 to 10 hydroxyl groups.

Preference is given to using alkyl glycosides of the formula $RO(G)_x$, where R is a primary straight-chain or methyl-branched, in particular methyl-branched in the 2 position, aliphatic radical having 8 to 22, preferably 12 to 18, carbon atoms, and G is a glycose unit having 5 or 6 carbon atoms, preferably glucose. The degree of oligomerization x, which gives the distribution of monoglycosides and oligoglycosides, is preferably a number between 1 and 10, particularly preferably x is between 1.2 and 1.4.

Preference is given to using alkoxylated, preferably ethoxylated or ethoxylated and propoxylated, fatty acid alkyl esters, preferably having 1 to 4 carbon atoms in the alkyl chain, in particular fatty acid methyl esters, as are described in Japanese patent application JP 58/217598, for example, or preferably those as are prepared by the process described in international patent application WO A 90/13533.

Suitable anionic surfactants of the sulfonate type are preferably the known ($C_9$–$C_{13}$)-alkylbenzenesulfonates, alpha-olefinsulfonates and alkanesulfonates. Also suitable are esters of sulfo fatty acids or the disalts of alpha-sulfo fatty acids. Further suitable anionic surfactants are sulfated fatty acid glycerol esters, which represent mono-, di- and triesters and mixtures thereof, as are obtained in the preparation by etherification by 1 mol of monoglycerol with 1 to 3 mol of fatty acid or during the transesterification of glycerides with 0.3 to 2 mol of glycerol.

Suitable alkylsulfates are, in particular, the sulfuric monoesters of ($C_{12}$–$C_{18}$)-fatty alcohols, such as lauryl alcohol, myristyl alcohol, cetyl alcohol or stearyl alcohol and the fatty alcohol mixtures obtained from coconut oil, palm oil and palm kernel oil which may additionally comprise fractions of unsaturated alcohols, e.g. oleyl alcohol.

Further suitable anionic surfactants are, in particular, soaps. Suitable compounds are saturated fatty acid soaps, such as the salts of lauric acid, myristic acid, palmitic acid, stearic acid, hydrogenated erucic acid and behenic acid, and, in particular, those soap mixtures derived from natural fatty acids, such as, for example, coconut, palm kernel or tallow fatty acids. The anionic surfactants can be present in the form of their sodium, potassium or ammonium salts, and as soluble salts of organic bases, such as mono-, di- or triethanolamine. The anionic surfactants are preferably in the form of their sodium or potassium salts, in particular in the form of the sodium salts.

The pH regulators are preferably soda, trona, potash, citric acid, sodium citrate and/or bicarbonate.

Finally, the laundry detergents and cleaners can optionally also comprise enzymes, such as, for example, protease, amylase, lipase and cellulase.

The invention also provides components for laundry detergent modular systems which preferably comprise 60 to 100% by weight of the builder composition according to the invention.

The invention further provides water softeners which comprise at least one of the builder compositions according to the invention. In regions of high water hardness, water softeners exercise a performance-enhancing effect on the washing result and a protective effect with regard to the washing machine.

Preferred water softeners comprise a) 0.5 to 99% by weight of the builder composition according to the invention b) optionally 0.5 to 80% by weight of cobuilders c) optionally 0 to 15% by weight of interface-active substances d) optionally 0.5 to 80% by weight of pH regulators The components a), b), c) and d) used are preferably the compounds listed above.

The builder composition according to the invention can expressly also be used as component for the preparation of compounds for laundry detergents and cleaners, water softeners and laundry detergent modular systems. With compounds, it is possible to achieve special effects. Thus, for example, liquid components can be incorporated into pulverulent or tablet laundry detergents and cleaners. Furthermore, the coloration or speckling of laundry detergents and cleaners is possible. It is likewise possible to achieve special disintegration effects, better dispersion of poorly dispersible components or the porosity of tablets.

Compounds with surfactants preferably comprise a) 70 to 99.5% by weight of the builder composition according to the invention, preferably used as powder with average particle sizes of from 1 to 500 $\mu$m, particularly preferably 20 to 100 $\mu$m, or in another embodiment preferably as granulate with an average particle size of from 200 to 2000 $\mu$m, preferably 300 to 900 $\mu$m, and b) 0.5 to 30% by weight of anionic, cationic, nonionic and/or zwitterionic surfactants.

The surfactants b) used are preferably the interface-active compounds listed above.

Other preferred compounds comprise a) 50 to 99% by weight of the builder composition according to the invention, b) 0.01 to 10% by weight of dye c) ad 100% by weight of further customary ingredients.

Compounds with polycarboxylate copolymers preferably comprise a) 70 to 99% by weight of the builder composition according to the invention, preferably as powder with average particle sizes of from 1 to 500 μm, particularly preferably 20 to 100 μm, or in another embodiment preferably as granulate with an average particle size of from 200 to 2000 μm, preferably 300 to 900 μm, and b) 0.5 to 30% by weight of polycarboxylate copolymers c) 0.5 to 30% by weight of water.

The polycarboxylate copolymers b) used are preferably the compounds listed above.

Compounds with pH regulators preferably comprise a) 60 to 99.5% by weight of the builder composition according to the invention, preferably used as powder with average particle sizes of from 1 to 500 μm, particularly preferably 20 to 100 μm, or in another embodiment preferably as granulate with an average particle size of from 200 to 2000 μm, preferably 300 to 900 μm, and b) 0.5 to 40% by weight of pH regulators c) ad 100% by weight of further customary ingredients.

The pH regulators b) used are preferably the compounds listed above.

Preference is given to using the compounds as powders with an average particle size of from 0.1 to 4000 μm, particularly preferably 10 to 500 μm, especially preferably 20 to 200 μm.

In a further preferred embodiment, the compounds are used as granulate with an average particle size of from 200 to 2000 μm, preferably 400 to 900 μm.

The compounds are preferably prepared either by agglomeration, grinding, size fractionation etc. or by compaction, grinding, size fractionation etc.

The laundry detergents, cleaners, water softeners and modular components can be used, for example, in powder form, granulate form, gel form, liquid form or tablet form.

To prepare the tablets, the respective formulation is compressed to give the corresponding shape using a tableting press, it being possible for the shape to take any form (e.g. cylindrical, tetrahedral, ellipsoidal, circular etc.). In the case of the cylindrical form, the ratio of radius to height may be between 0.2 and 5. The compression force can be between 12 and 0.3 kN/cm$^2$. The compression force is essentially independent of the geometric shape of the tablet.

For the tableting of machine dishwashing cleaners, compression forces of from 0.7 to 14.2 kN/cm$^2$ are preferred, and particular preference is given to forces of from 2.8 to 10 kN/cm$^2$.

Multistage compression to give more complex forms is also preferred. Division into various compartments serves for a certain separation of ingredients which are otherwise incompatible with one another.

For multilayer tablets, any desired proportions of the formulation are compressed onto one another in two or more steps one after the other, giving two or more layers. In the case of a two-layer tablet, a layer thickness ratio of the two layers of from 1:10 to 10:1 is particularly preferred.

Other use forms are, for example, tablets with incorporated spherical compartments. The various layers and compartments of the tablets may also be differently colored.

The invention also provides a process for the preparation of a builder composition, which comprises bringing a) crystalline layered sodium silicate of the formula $NaMSi_xO_{2x+1}*yH_2O$, where M is sodium or hydrogen, x is a number from 1.9 to 4 and y is a number from 0 to 20, and b) water or an aqueous solution or dispersion of at least one detergent ingredient, c) where the ratio of component a) to the water from component b) is 0.5:1 to 20:1, into contact with one another and subsequently heat-treating the resulting builder composition at 30 to 400° C. for 0.5 to 1000 min.

The invention further provides a method of reducing the dissolution residue of a builder composition comprising an intimate mixture of a) crystalline layered sodium silicate of the formula $NaMSi_xO_{2x+1}*yH_2O$, where M is sodium or hydrogen, x is a number from 1.9 to 4 and y is a number from 0 to 20, and b) water or an aqueous solution or dispersion of at least one laundry detergent ingredient, c) where the ratio of component a) to the water from component b) is 0.5:1 to 20:1, which comprises heat-treating the builder composition at 30 to 400° C. for 0.5 to 1000 min.

Intimate mixture of components a) and b) is here to be understood as meaning a composition as is obtained after bringing components a) and b) into contact and optionally subsequently further treating them mechanically. The builder composition itself may also be a mixture with other builders, such as, for example, non-layered silicates, zeolites, phosphates etc.

The examples below serve to illustrate the invention without, however, limiting it.

Determination of the phase composition of the crystalline layered sodium disilicates used:

A triturated solid sample is measured in a Philips PW1710 X-ray powder diffractometer (CuK alpha 2 radiation, wavelength 1.54439 Angström, accelerating potential 35 kV, heating current 28 mA, monochromator, scanning speed 3 degrees 2 theta per minute). The resulting intensities were evaluated as follows:

| substance | characteristic peak (d value in Angström) |
|---|---|
| alpha phase | 3.29 +/− 0.07, typically 3.31 |
| beta phase | 2.97 +/− 0.06 |
| delta-phase | 3.97 +/− 0.08 |

The crystalline portions in percentage by weight are calculated from the intensities $I_a$, $I_b$ and $I_d$—measured in pulses—of the alpha, beta and delta phase in accordance with the following formulae:

| | |
|---|---|
| alpha content: | $A\,[\%] = 100 * I_a/(I_a + I_b + I_d)$ |
| beta content: | $B\,[\%] = 1.41 * 100 * I_b/(I_a + I_d)$ |
| delta content: | $D\,[\%] = 100 - A - D$ |

To determine the X-ray amorphous fraction (AM), the background (pulse) of the X-ray peak was determined at a d value of 2.65 Angström ($I_{am}$) and converted into the percentage content using the following empirical formula:

$$AM[\%]=(I_{am}-70)*100/450$$

If X-ray amorphous fractions are also specified in an analysis in addition to the crystalline fractions, then the A, B, C contents are corrected by AM.

Compaction, Grinding and Size Fractionation of the Builder Compositions:

In a roll compactor (Hosokawa-Bepex) the starting material was conveyed between the compactor rolls using a stuffing screw (setting: stage 5). This is performed at such a rate that a linear compression force of from 2 to 200 kN/cm of roll width, preferably between 10 and 160 kN/cm of roll width, resulted. The roll rotation was set at stage 3 to 7, and the roll gap was 0.1 mm. The resulting flakes (length about 50 mm, thickness about 2 to 5 mm, width about 10 to 15 mm) were crushed in a hammer mill (UPZ model, Alpine) with a perforation diameter of 5 mm at a rotary speed of from 600 to 1400 rpm. From the crushed pulverulent product, oversize material was separated off (using a screen with a perforation diameter of 1000 $\mu$m), as was undersize material (screen with perforation diameter of 300 $\mu$m). The oversize material was subjected to a further grinding stage and screened again. The two fractions with particle size between 300 $\mu$m and 1000 $\mu$m were combined.

Determination of the Particle Distribution of the Builder Compositions by Screen Analysis:

The inserts with the desired screens were inserted into a screening machine from Retsch. The mesh width of the screens decreases from top to bottom. 50 g of the powder to be investigated were placed on the widest screen. As a result of the vibratory movement of the screening machine, the powder material was conveyed through the various screens. The residues on the screens were weighed and calculated relative to the initial weight of the material. The $d_{50}$ value could be calculated from the results.

Preparation of the Test Detergents:

The optical brighteners were stirred into a quarter of the amount of molten alkyl ethoxylate and mixed in a domestic multimixer (Braun) with half of the amount of soda or bicarbonate or phosphate. In a Lödige plowshare mixer, the remaining soda and the total amounts of builder composition according to the invention, phosphate, zeolite, bicarbonate, citric acid and polymer were mixed at 300 rpm for 15 minutes. Then, half of the remaining alkyl ethoxylate was sprayed on over the course of 5 minutes. Finally, alkanesulfonate, polyvinylpyrrolidone, alkylbenzenesulfonate, soap, antifoam, phosphonate and compound with optical brightener were added and subsequently mixed for 10 minutes at 300 rpm. In a tumble mixer, the mixture from the Lödige mixer was admixed, with low shear stress, with percarbonate, perborate, TAED and enzymes, and mixed for 5 minutes.

Tableting of Detergents:

For tableting, the detergent formulations were mixed and compressed to the appropriate shape using a tableting press from Matra. The compression force was between 12 and 0.3 kN/cm$^2$. The compacts had a height of about 18 mm and a diameter of 41 mm.

Preparation of the Machine Dishwashing Cleaners:

The solid components, apart from enzyme, bleach and perfume, were introduced into a Lödige plowshare mixer and thoroughly mixed. The alkyl ethoxylate was then sprayed on. Enzymes, perfume and bleaching system were finally mixed in.

Carrying out the Dissolution Residue Test:

800 ml of tap water (water hardness 20 degrees German hardness, molar ratio Ca:Mg=about 4:1) were heated to 20° C. 2 g of the test substance were added and the mixture was stirred for 20 min using a magnetic stirrer. Using a gentle vacuum from a water jet pump, the dispersion was sucked in a Büchner funnel (diameter about 95 mm) through a cotton fabric (WFK 10A type from wfk-Testgewebe GmbH, Christenfeld 10, 41379 Brueggen, Germany). The screen was dried at 80 to 100° C. for 1 hour in a convection drying oven. The weight increase was based on the initial weight, normalized to % and referred to as dissolution residue (KRT in %).

EXAMPLE 1 (COMPARISON)

The solubility residue of a commercially available crystalline layered sodium disilicate granulate (SKS-6 granulate, Clariant GmbH) was determined (see table 1).

EXAMPLE 2 (COMPARISON)

8 kg of a powder mixture were prepared in a Lödige plowshare mixer from 7.52 kg of crystalline layered sodium disilicate (SKS-6 powder, Clariant GmbH, 77% by weight of delta, 16% by weight of alpha, 3% by weight of beta disilicate phase, 3.8% by weight of amorphous fraction, 0.2% water) and 480 g of water, and its dissolution residue was measured (see table 1).

EXAMPLE 3 (COMPARISON)

The powder mixture from example 2 was processed in a roll compactor at a linear compression force of 90 kN/cm of roll length. About 3 kg of acceptable-size material were obtained, the dissolution residue of which was determined (see table 1).

EXAMPLE 4 (COMPARISON)

8 kg of a powder mixture were prepared in a Lödige plowshare mixer from 7.12 kg of crystalline layered sodium disilicate (SKS-6 powder, Clariant GmbH) and 0.88 kg of waterglass (grade Na 9/1 from Clariant France, $SiO_2$=30.6% by weight, $Na_2O$=15.1% by weight, $H_2O$=54.3% by weight, corresponding to $Na_2O/SiO_2$=0.48 (mol/mol) and $H_2O/SiO_2$=5.92 (mol/mol)). This was processed in a roll compactor at a linear compression force of 90 kN/cm of roll length. About 3 kg of acceptable-size material were obtained, the dissolution residue of which was determined (see table 1).

EXAMPLE 5

8 kg of a powder mixture were prepared in a Lödige plowshare mixer from 7.52 kg of crystalline layered sodium disilicate (SKS-6 powder, Clariant GmbH) and 480 g of water. This was heat-treated in a drying cabinet for 30 min at 80° C. The dissolution residue of a sample was determined (see table 1).

EXAMPLE 6

The heat-treated material from example 5 was processed in a roll compactor at a linear compression force of 90 kN/cm of roll length. About 3 kg of acceptable-size material were obtained, the dissolution residue of which was determined (see table 1).

EXAMPLE 7

8 kg of a powder mixture were prepared in a Lödige plowshare mixer from 7.12 kg of crystalline layered sodium disilicate (SKS-6 powder, Clariant GmbH) and 880 g of waterglass (grade Na 9/1 from Clariant France). This was heat-treated in a drying cabinet for 30 min at 80° C. and the dissolution residue was determined (see table 1).

EXAMPLE 8

8 kg of a powder mixture were prepared as in example 7, heat-treated in a drying cabinet for 30 min at 80° C. and processed in a roll compactor at a linear compression force of 90 kN/cm of roll length. About 3 kg of acceptable-size material were obtained, the dissolution residue of which was determined (see table 1).

EXAMPLE 9

8 kg of a powder mixture were prepared in a Lödige plowshare mixer from 7.88 kg of crystalline layered sodium disilicate (SKS-6 powder, Clariant GmbH) and 120 g of water. This was heat-treated in a drying cabinet for 30 min at 80° C. and processed in a roll compactor at a linear compression force of 90 kN/cm of roll length. About 3 kg of acceptable-size material were obtained, the dissolution residue of which was determined (see table 1).

EXAMPLE 10

8 kg of a powder mixture were prepared in a Lödige plowshare mixer from 7.36 kg of crystalline layered sodium disilicate (SKS-6 powder, Clariant GmbH) and 640 g of water. This was heat-treated in a drying cabinet for 30 min at 80° C. and processed in a roll compactor at a linear compression force of 90 kN/cm of roll length. About 3 kg of acceptable-size material were obtained, the dissolution residue of which was determined (see table 1).

EXAMPLE 11

8 kg of a powder mixture were prepared in a Lödige plowshare mixer from 7.76 kg of crystalline layered sodium disilicate (SKS-6 powder, Clariant GmbH) and 240 g of waterglass (grade Na 9/1 from Clariant France). This was heat-treated in a drying cabinet for 30 min at 80° C. and processed in a roll compactor at a linear compression force of 90 kN/cm of roll length. About 3 kg of acceptable-size material were obtained, the dissolution residue of which was determined (see table 1).

EXAMPLE 12

8 kg of a powder mixture were prepared in a Lödige plowshare mixer from 6.8 kg of crystalline layered sodium disilicate (SKS-6 powder, Clariant GmbH) and 1.2 kg of waterglass (grade Na 9/1 from Clariant France). This was heat-treated in a drying cabinet for 30 min at 80° C. and processed in a roll compactor at a linear compression force of 90 kN/cm of roll length. About 3 kg of acceptable-size material were obtained, the dissolution residue of which was determined (see table 1).

EXAMPLE 13

8 kg of a powder mixture were prepared in a Lödige plowshare mixer from 7.12 kg of crystalline layered sodium disilicate (SKS-6 powder, Clariant GmbH), 320 g of condensate and 560 g of waterglass (grade Na 9/1 from Clariant France). This was heat-treated in a drying cabinet for 30 min at 80° C. and processed in a roll compactor at a linear compression force of 90 kN/cm of roll length. About 3 kg of acceptable-size material were obtained, the dissolution residue of which was determined (see table 1).

EXAMPLE 14

8 kg of a powder mixture were prepared in a Lödige plowshare mixer from 7.12 kg of crystalline layered sodium disilicate (SKS-6 powder, Clariant GmbH) and 880 g of waterglass (grade Na 4/1 from Clariant France, $SiO_2$=28.3% by weight, $Na_2O$=8.3% by weight, $H_2O$=63.4% by weight, corresponding to $Na_2O/SiO_2$=0.284 (mol/mol) and $H_2O/SiO_2$=7.472 (mol/mol). This was heat-treated in a drying cabinet for 30 min at 80° C. and processed in a roll compactor at a linear compression force of 90 kN/cm of roll length. About 3 kg of acceptable-size material were obtained, the dissolution residue of which was determined (see table 1).

EXAMPLE 15

8 kg of a powder mixture were prepared in a Lödige heatable plowshare mixer initially at room temperature from 7.12 kg of crystalline layered sodium disilicate (SKS-6 powder, Clariant GmbH) and 880 g of waterglass (grade Na 9/1 from Clariant France). The material was then heat-treated in a mixer for 15 min at 95° C. and processed in a roll compactor at a linear compression force of 90 kN/cm of roll length. About 3 kg of acceptable-size material were obtained, the dissolution residue of which was determined.

EXAMPLE 16

8 kg of a powder mixture were prepared in a Lödige plowshare mixer from 7.12 kg of crystalline layered sodium disilicate (SKS-6 powder, Clariant GmbH) and 880 g of waterglass (grade Na 9/1 from Clariant France). This was heat-treated in a drying cabinet for 90 min at 45° C. and processed in a roll compactor at a linear compression force of 90 kN/cm of roll length. About 3 kg of acceptable-size material were obtained, the dissolution residue of which was determined (see table 1).

EXAMPLE 17

8 kg of a powder mixture were prepared in a Lödige plowshare mixer from 7.12 kg of crystalline layered sodium disilicate (SKS-6 powder, Clariant GmbH) and 880 g of waterglass (grade Na 9/1 from Clariant France). This was heat-treated in a drying cabinet for 10 min at 200° C. and processed in a roll compactor at a linear compression force of 90 kN/cm of roll length. About 3 kg of acceptable-size material were obtained, the dissolution residue of which was determined (see table 1).

EXAMPLE 18

8 kg of a powder mixture were prepared in an Eirich mixer initially at room temperature from 7.12 kg of crystalline layered sodium disilicate (SKS-6 powder, Clariant GmbH) and 880 g of waterglass (grade Na 9/1 from Clariant France). The material was then heat-treated in a Lödige heatable plowshare mixer for 30 min at 80° C. and processed in a roll compactor at a linear compression force of 55 kN/cm of roll length. About 3 kg of acceptable-size material were obtained, the dissolution residue of which was determined (see table 1).

EXAMPLE 19

8 kg of a powder mixture were prepared in an Eirich mixer initially at room temperature from 7.12 kg of crystalline layered sodium disilicate (SKS-6 powder, Clariant GmbH) and 880 g of waterglass (grade Na 9/1 from Clariant France). The material was then heat-treated in a Lödige heatable plowshare mixer for 30 min at 80° C. and processed in a roll compactor at a linear compression force of 160 kN/cm of roll length. About 3 kg of acceptable-size material were obtained, the dissolution residue of which was determined (see table 1).

EXAMPLE 20a 4 kg of the material from example 5 were ground for about 60 min using a U 280A0 ball mill from Welte which is metal-clad on the inside and whose drum rotates at about 50 rpm. The grinding bodies used were 44 kg of porcelain beads. The material had an average particle diameter of 63 micrometers and produced a dissolution residue of about 50%.

EXAMPLE 20b 4 kg of the material from example 8 were ground for about 60 min using a U 280A0 ball mill from Welte which is metal-clad on the inside and whose drum rotates at about 50 rpm. The grinding bodies used were 44 kg of porcelain beads. The material had an average particle diameter of 55 micrometers and produced a dissolution residue of 7%.

EXAMPLE 21a

Analogously to EP 0 849 355, 5.3 kg of builder composition according to the invention from example 5 were agglomerated in an Eirich mixer with 2.7 kg of a solution of acidic polycarboxylate (Stockhausen, grade W78230, 45% strength solution, 9.5 mmol of $H^+$/g of active substance) to give 8 kg of granulate and dried to a moisture content of about 6.3%.

EXAMPLE 21b

In accordance with U.S. Pat. No. 5,540,855, 5.6 kg of builder composition according to the invention from example 7 were mixed in a Lödige plowshare mixer with 2.4 kg of citric acid to give 8 kg of a powder mixture. The mixture was processed in a roll compactor at a compression force of 90 kN/cm of roll width.

EXAMPLE 21c

In accordance with D19960744, 7.6 kg of builder composition according to the invention from example 8 are firstly mixed with 23 g Sandolan Blue E-HRL 180 and then sprayed with a solution of 53.3 g of Genapol DU 110 and 13 g of isopropanol in 304 g of water on a rounding plate.

EXAMPLES 22 to 26

Test detergents with the compositions given in table 2a were prepared in accordance with the general procedure "Preparation of the test detergents".

EXAMPLE 27

A water softener formulation corresponding to table 2a was prepared in a Lödige plowshare mixer, the solid components being mixed for 15 minutes at 300 rpm. The alkyl ethoxylate was melted and sprayed on with mixing.

EXAMPLE 28

Detergent tablets with compositions corresponding to table 2a were prepared in accordance with the general procedure "Preparation of the test detergents" and "Tableting of detergents".

EXAMPLES 29 to 34

Test detergents with the compositions given in table 2b were prepared in accordance with the general procedure "Preparation of the test detergents".

EXAMPLE 35

A stain removal salt formulation corresponding to table 2b was prepared in a Lödige plowshare mixer, the solid components being mixed for 15 minutes at 300 rpm. The alkanesulfonate was melted and sprayed on with mixing.

EXAMPLES 36 to 38

Machine dishwashing cleaners with the compositions corresponding to table 3 were prepared in accordance with the general procedure "Preparation of the machine dishwashing cleaners".

EXAMPLE 39

A machine dishwashing cleaner gel with the composition given in table 4 was prepared by mixing waterglass, phosphate, soda, sodium hydroxide, phosphonate, polymer, alkanesulfonate, phosphoric ester together in a disperser (Ultraturrax, Hanke and Kunkel). The builder composition according to the invention as in example 20a and sodium hypochlorite are finally mixed in.

Chemicals Used:

| | |
|---|---|
| AE 1 | ® Genapol OA 050, Clariant GmbH |
| AE 2 | ® Genapol 2822, Clariant GmbH |
| Alkanesulfonate | ® Hostapur SAS 60, Clariant GmbH |
| Alkylbenzenesulfonate | ® Marlon ARL, Hüls |
| Antifoam | ® 11 Plv ASP3, Wacker |
| Citric acid | Jungbunzlauer |
| CMC | ® Tylose 2000, Clariant GmbH |
| Enzyme 1 | ® Termamyl 60T, Solvay Enzymes |
| Enzyme 2 | ® Termamyl 120T, Solvay Enzymes |
| Enzyme 3 | ® Savinase 6.0 TW, Solvay Enzymes |
| NaDCC | Olin Chemicals |
| Sodium acetate th | Merck KGaA |
| Sodium bicarbonate | Solvay |
| Sodium chloride | Merck KGaA |
| Sodium citrate th | Jungbunzlauer |
| Sodium hydroxide | Microprills 100%, Riedel-de-Haen |
| Sodium hypochlorite | Celanese GmbH |
| Sodium metasilicate ph | VanBaerle |
| Sodium perborate mh | Degussa |
| Sodium perborate th | Degussa |
| Sodium percarbonate | ® Oxyper C, Solvay Interox |
| Sodium phosphate 1 | Sodiumtripolyphosphate, Thermphos Intl. |
| Sodium phosphate 2 | ® Makrophos 1018, BK Giulini |
| Sodium phosphate 3 | ® Thermphos NW coarse, Thermphos Intl. |
| Sodium sulfate | Solvay |
| Sodium waterglass | 45.5% active substance, modulus 2.0, Clariant France SA |
| Optical brightener | ® Tinopal CBS-X, Ciba |
| Perfume | Lemon perfume 78122D, Orissa |
| Phosphonate 1 | ® Dequest 2041, Monsanto |
| Phosphonate 2 | ® Dequest 200, Monsanto |
| Polycarboxylate 1 | ® Sokalan CP5 powder, BASF |
| Polycarboxylate 2 | ® Sokalan CP45, BASF |
| Polycarboxylate 3 | ® Sokalan CP5 liquid, BASF |
| Polyvinylpyrrolidone | ® Sokalan HP50, BASF |
| Soap | ® Liga base soap HM11E |
| Soda | Heavy soda, Matthes&Weber |
| Soil release polymer | ® Texcare SRA-100, Clariant GmbH |
| TAED 1 | ® Peractive AN, Clariant GmbH |
| TAED 2 | ® Peractive AC White, Clariant GmbH |

TABLE 1

| Examples | 1 Comp. | 2 Comp. | 3 Comp. | 4 Comp. | 5 Powd. | 6 Gran | 7 Powd. | 8 Gran | 9 Gran |
|---|---|---|---|---|---|---|---|---|---|
| SKS-6 (% by wt.) | 97.1 | 94 | 94 | 89 | 94 | 94 | 89 | 89 | 98.5 |
| Water (% by wt.) | 2.9 | 6 | 6 | — | 6 | 6 | — | — | 1.5 |
| Waterglass (% by wt.) | — | — | — | 11 | — | — | 11 | 11 | — |
| Waterglass type | — | — | — | a) | — | — | a) | a) | — |
| SKS-6/$H_2O$ (mol/mol) | 3.31 | 1.55 | 1.55 | 1.47 | 1.55 | 1.55 | 1.47 | 1.47 | 6.49 |
| SKS-6/LDI (w/w) | — | — | — | 17.7 | — | — | 17.7 | 17.7 | — |
| Storage time (min) | — | 0 | 0 | 0 | 30 | 30 | 30 | 30 | 30 |
| Storage temp. (° C.) | — | — | — | — | 80 | 80 | 80 | 80 | 80 |
| Compression force (kN/cm) | — | — | 90 | 90 | — | 90 | — | 90 | 90 |
| Dissolution residue (%) | 55 | 85 | 50 | 53 | 65 | 18 | 60 | 6 | 25 |
| $d_{50}$ ($\mu$m) | 640 | — | — | — | — | — | 150 | 670 | — |

| Examples | 10 Gran | 11 Gran | 12 Gran | 13 Gran | 14 Gran | 15 Gran | 16 Gran | 17 Gran | 18 Gran | 19 Gran |
|---|---|---|---|---|---|---|---|---|---|---|
| SKS-6 (% by wt.) | 92 | 97 | 85 | 89 | 89 | 89 | 89 | 89 | 89 | 89 |
| Water (% by wt.) | 8 | — | — | 4 | — | — | — | — | — | — |
| Waterglass (% by wt.) | — | 3 | 15 | 7 | 11 | 11 | 11 | 11 | 11 | 11 |
| Waterglass type | — | a) | a) | a) | b) | a) | a) | a) | a) | a) |
| SKS-6/$H_2O$ (mol/mol) | 1.14 | 5.89 | 1.03 | 2.29 | 1.26 | 1.47 | 1.47 | 1.47 | 1.47 | 1.47 |
| SKS-6/LDI (w/w) | — | 70.75 | 12.4 | 27.82 | 22.11 | 17.7 | 17.7 | 17.7 | 17.7 | 17.7 |
| Storage time (min) | 30 | 30 | 30 | 30 | 30 | 15 | 90 | 10 | 30 | 30 |
| Storage temp. (° C.) | 80 | 80 | 80 | 80 | 80 | 95 | 45 | 200 | 80 | 80 |
| Compression force (kN/cm) | 90 | 90 | 90 | 90 | 90 | 90 | 90 | 90 | 55 | 160 |
| Dissolution residue (%) | 15 | 17 | 12 | 8 | 7 | 13 | 16 | 12 | 19 | 9 |
| $d_{50}$ ($\mu$m) | — | — | — | — | — | — | — | — | — | — |

a) = Na 9/1
b) = Na 4/1
Comp. = comparative example
Powd. = powder
Gran = granulate
LDI = laundry detergent ingredient TABLE 2 a

| Examples | | 22 | 23 | 24 | 25 | 26 | 27 | 28 |
|---|---|---|---|---|---|---|---|---|
| Phyllosilicate from ex. 13 | % | 45 | 15 | — | 10 | 10 | 15 | 12 |
| Phyllosilicate from ex. 8 | % | — | — | 5 | — | — | — | — |
| Zeolite A | % | — | 20 | 20 | — | 30 | 40 | 13 |
| Sodium phosphate 1 | % | — | — | — | 25 | — | — | — |
| Polycarboxylate 1 | % | — | 6 | 3 | — | 7 | 7 | 8 |
| Soda | % | — | 13 | 18 | — | — | 15 | 10 |
| Sodium bicarbonate | % | 15 | — | — | — | 18 | 5 | — |
| Sodium perborate mh | % | — | 18 | — | — | — | — | — |
| Sodium perborate th | % | — | — | 20 | 20 | — | — | — |
| Sodium percarbonate | % | 18 | — | — | — | — | — | 10 |
| TAED 1 | % | 5 | 5 | 2.5 | — | — | — | 5 |
| Alkylbenzenesulfonate | % | — | 9 | 9 | 6.7 | 8 | — | 14 |
| Alkanesulfonate | % | — | — | — | — | — | — | — |
| AE 1 | % | 10 | 8 | 5 | 2.2 | 10 | 2 | 4 |
| Soap | % | — | 1.5 | — | — | 1 | 2 | 1.5 |
| Antifoam | % | 1 | 1 | 0.6 | 0.6 | 1 | — | 1 |
| Enzyme 1 | % | 1.5 | 1.5 | 0.6 | 0.6 | 1.5 | — | 1 |
| Enzyme 3 | % | 1.5 | 1.5 | 0.6 | 0.6 | 1.5 | — | 1 |
| Optical brightener | % | 0.5 | 0.5 | 0.2 | 0.2 | — | — | 0.5 |
| Phosphonate 1 | % | 0.2 | — | 0.1 | 0.1 | 0.2 | — | 0.2 |
| Citric acid | % | — | — | — | — | 2 | 5 | 5 |
| Polyvinylpyrrolidone | % | — | — | — | — | 1 | — | — |
| Soil release polymer | % | — | — | — | — | 0.8 | — | 1 |
| CMC | % | — | — | — | — | 1 | — | — |
| Sodium sulfate | % | 2.3 | — | 15.4 | 34 | 7 | 9 | 5.8 |
| Sodium chloride | % | — | — | — | — | — | — | — |
| Sodium acetate th | % | — | — | — | — | — | — | 7 |
| Concentration | — | 65 g | 72 g | 135 g | 135 g | 72 g | 30 g | 2*40 g |

TABLE 2 b

| Examples | | 29 | 30 | 31 | 32 | 33 | 34 | 35 |
|---|---|---|---|---|---|---|---|---|
| Phyllosilicate from ex. 13 | % | 20 | — | — | 4 | — | — | 9 |
| Phyllosilicate from ex. 8 | % | — | 20 | — | — | 12 | — | — |
| Phyllosilicate from ex. 19 | % | — | — | 40 | — | — | 5 | — |
| Zeolite A | % | 31 | 31 | 16 | 29 | — | — | — |
| Sodium phosphate 1 | % | — | — | — | — | — | — | — |
| Polycarboxylate 1 | % | 5 | — | 3 | 3 | 2 | 2 | — |
| Soda | % | — | 5 | 5 | 40 | 29 | 76 | 34 |
| Sodium bicarbonate | % | — | — | — | — | — | — | — |
| Sodium perborate mh | % | — | — | — | — | — | 3 | — |
| Sodium perborate th | % | — | — | — | — | — | 2 | — |
| Sodium percarbonate | % | — | — | — | — | — | — | 21 |
| TAED 1 | % | — | — | — | — | — | — | 7 |
| Alkylbenzenesulfonate | % | 10 | 30 | — | 7 | 6.5 | — | — |
| Alkanesulfonate | % | — | — | — | 9 | 4.5 | 9 | 4 |
| AE 1 | % | 25 | 7 | 18 | 3 | — | 3 | — |
| Soap | % | — | — | 13 | — | — | — | 1 |
| Antifoam | % | — | — | — | — | — | — | — |
| Enzyme 1 | % | 1.5 | 0.5 | 0.5 | 0.3 | — | — | — |
| Enzyme 3 | % | 1.5 | 0.5 | 0.5 | 0.3 | — | — | — |
| Optical brightener | % | — | 0.5 | — | — | — | — | — |
| Phosphonate 1 | % | — | — | — | — | — | — | — |
| Citric acid | % | — | — | — | — | — | — | |
| Polyvinylpyrrolidone | % | — | — | — | — | — | — | — |
| Soil release polymer | % | — | — | — | — | — | — | — |
| CMC | % | — | — | — | — | — | — | — |
| Sodium sulfate | % | 6 | 5.5 | 4 | 4.4 | — | — | 22 |
| Sodium chloride | % | — | — | — | — | 46 | — | 2 |
| Sodium acetate th | % | — | — | — | — | — | — | — |
| Concentration | — | 0.5 g/l | 0.5 g/l | 0.5 g/l | 80 g | 80 g | 150 g | 40 g |

TABLE 3

| Examples | | 36 | 37 | 38 |
|---|---|---|---|---|
| Phyllosilicate from ex. 13 | % | 5 | — | — |
| Phyllosilicate from ex. 14 | % | — | 5.2 | — |
| Phyllosilicate from ex. 17 | % | — | — | 3 |
| Sodium phosphate 2 | % | — | 47 | 20 |
| Sodium metasilicate ph | % | — | — | 47 |
| Soda | % | 32.7 | 27.5 | 18 |
| Sodium hydroxide | % | — | — | 8 |
| Sodium citrate th | % | 35.0 | — | — |
| Sodium percarbonate | % | 10 | — | — |
| Sodium perborate mh | % | — | 10 | — |
| NaDCC | % | — | — | 1 |
| Polycarboxylate 2 | % | 7.5 | 3.5 | — |
| TAED 2 | % | 5 | 2 | — |
| Enzyme 2 | % | 1.5 | 1.5 | — |
| Enzyme 3 | % | 1.5 | 1.5 | — |
| AE 2 | % | 1.5 | 1.5 | 3 |
| Perfume | % | 0.3 | 0.3 | — |
| Concentration | — | 20 g | 20 g | 2 g/l |

TABLE 4

| Example | | 39 |
|---|---|---|
| Sodium phosphate 3 | % | 25 |
| Phyllosilicate from ex. 13 | % | 5 |
| Soda | % | 1 |
| Sodium hydroxide | % | 1 |
| Phosphonate 2 | % | 0.5 |
| Polycarboxylate 3 | % | 2 |
| Alkanesulfonate | % | 1.5 |
| Waterglass | % | 35 |
| Sodium hypochlorite | % | 9 |
| Water | % | 20 |
| Concentration | g | 40 |

What is claimed is:

1. A method for preparing a builder composition comprising contacting a) crystalline layered sodium silicate of the formula $NaMSi_xO_{2x+1}*yH_2O$, where M is sodium or hydrogen, x is a number from 1.9 to 4 and y is a number from 0 to 20, and b) an aqueous solution or dispersion of an alkali metal silicate, c) where a molar ratio of the crystalline layered sodium silicate a) to the aqueous solution or dispersion of alkali metal silicate b) is 0.5:1 to 20:1, and subsequently heat-treating the resulting builder composition at a temperature of 30 to 400° C. for a duration of 0.5 to 1000 min.

2. The method for preparing a builder composition as claimed in claim 1, wherein the crystalline layered sodium silicate a) comprises 0 to 40% by weight of alpha-sodium disilicate, 0 to 40% by weight of beta-sodium disilicate, 40 to 100% by weight of delta-sodium disilicate and 0 to 40% by weight of amorphous fractions.

3. The method for preparing a builder composition as claimed in claim 1, wherein the crystalline layered sodium silicate a) comprises additional cationic and/or anionic constituents.

4. The method for preparing a builder composition as claimed in claim 1, wherein the resulting builder composition further comprises a detergent ingredient selected from the group consisting of nonionic surfactants, anionic surfactants, cationic surfactants, polycarboxylate polymers, polycarboxylate copolymers, polyethylene glycols, bentonites, hectorites, saponites, dyes, and mixtures thereof.

5. The method for preparing a builder composition as claimed in claim 1, wherein the alkali metal silicate is a waterglass of molar composition $Me_2O:SiO_2$ equal to 0.2:1 to 1:1 where Me=Na and/or K and $H_2O:SiO_2$ equal to 0.9:1 to 250:1.

6. The method for preparing a builder composition as claimed in claim 4, wherein the weight ratio of crystalline layered sodium silicate a) to the detergent ingredients b) is 5:1 to 1000:1.

7. The method for preparing a builder composition as claimed in claim 1, wherein the heat. treating is carried out at temperatures of from 40 to 300° C.

8. The method for preparing a builder composition as claimed in claim 1, wherein the duration of the heat treatment is 2 to 1000 min.

9. The method for preparing a builder composition of claim 1, further comprising mechanically treating hte resulting builder compositon in a mechnaical treating step selected from the group consisting of compaction, granulation, grinding, comminution or size fractionation, and mixtures thereof.

10. The method for preparing a builder composition of claim 1, see source mechanically treating comprises roll compaction carried out with a linear compression force of from 2 to 200 kN/cm of roll width and at a compaction temperature of from 20 to 200° C.

11. The method for preparing a builder composition as claimed in claim 1, further comprising the steps selected from the group consisting of grinding, comminution, ground/comminuting, size-fractionating, and mixtures thereof.

12. The method for preparing a builder composition as claimed in claim 1, further comprising the steps of compacting, grinding and size-fractionating prior to the heat-treating step.

13. The method for preparing a builder composition as claimed in claim 1, wherein the builder composition is a powder having an average particle size of from 0.1 to 4000 $\mu$m.

14. The method for preparing a builder composition as claimed in claim 1, wherein the builder composition is a granulate having an average particle size of from 200 to 2000 $\mu$m.

15. The method for preparing a builder composition as claimed in claim 1, wherein the builder composition is a ground granulate with an average particle size of from 0.1 to 300 $\mu$m.

16. The method for preparing a builder composition as claimed in claim 1, wherein the builder composition comprises a dissolution residue of less than or equal to 50% in an aqueous 0.25% by weight solution at 20° C. after stirring for 20 minutes.

17. A laundry detergent or cleaner comprising the builder composition prepared according to the method of claim 1.

18. The laundry detergent or cleaner, comprising a) 0.5 to 99% by weight of the builder composition prepared according to the method of claim 1;

b) optionally 0.5 to 80% by weight of cobuilders;

c) optionally 1 to 50% by weight of interface-active substances;

d) optionally 1 to 70% by weight of bleaching systems;

e) optionally 0.5 to 80% by weight of pH regulators; and f) up to 100% by weight of further customary ingredients.

19. A water softener comprising the builder composition prepared according to the method of claim 1.

20. The water softener as claimed in claim 19, comprising a) 0.5 to 99% by weight of said builder composition;

b) optionally 0.5 to 80% by weight of cobuilders;

c) optionally 0 to 15% by weight of interface-active substances; and d) optionally 0.5 to 80% by weight of pH regulators.

21. A composition comprising the builder composition prepared according to the method of claim 1.

22. The composition as claimed in claim 20, comprising a) 70 to 99.5% by weight of said builder composition;

b) 0.5 to 30% by weight of a surfactant selected from the group consisting of an anionic, a cationic, a nonionic a zwitterionic surfactant, and mixtures thereof.

23. The composition as claimed in claim 21, comprising a) 50 to 99% by weight of said builder composition;

b) 0.01 to 10% by weight of dye; and c) up to 100% by weight of further customary ingredients.

24. The composition as claimed in claim 21, comprising a) 70 to 99% by weight of said builder composition;

b) 0.5 to 30% by weight of polycarboxylate copolymers; and d) 0.5 to 30% by weight of water.

25. The composition as claimed in claim 21, comprising a) 60 to 99.5% by weight of said builder composition;

b) 0.5 to 40% by weight of pH regulators; and b) up to 100% by weight of further customary ingredients.

26. The composition as claimed in claim 21 in the form of a tablet.

27. A process for the preparation of a builder composition, which comprises contacting a) crystalline layered sodium silicate of the formula $NaMSi_xO_{2x+1}*yH_2O$, where M is sodium or hydrogen, x is a number from 1.9 to 4 and y is a number from 0 to 20, and b) an aqueous solution or dispersion of an alkali metal silicate, c) where the molar ratio of said silicate a) aqueous solution or dispersion of the alkali metal silicate b) is 0.5:1 to 20:1, to provide a resulting builder composition and subsequently heat-treating the resulting builder composition at a temperature of 70 to 150° C. for a duration of 0.5 to 1000 min.

28. A method of reducing the dissolution residue of a builder composition comprising forming an intimate mixture of a) crystalline layered sodium silicate of the formula $NaMSi_xO_{2x+1}*yH_2O$, where M is sodium or hydrogen, x is a number from 1.9 to 4 and y is a number from 0 to 20, and b) an aqueous solution or dispersion of an alkali metal silicate, c) where the molar ratio of said crystalline layered sodium silicate a) to the aqueous solution or dispersion of the alkali metal silicate b) is 0.5:1 to 20:1, and heat-treating the mixture at 30 to 400° C. for 0.5 to 1000 min to provide said builder composition.

29. The method for preparing a builder composition of claim 4, wherein the weight ratio of crystalline layered sodium silicate a) to the aqueous soluction or dispersion of alkali metal silicate b) comprises 7:1 to 200:1.

30. The method for preparing a builder composition of claim 7, wherein the heat treatment is carried out at temperatures from 60 to 200° C.

31. The method for preparing a builder composition of claim 7, wherein the heat treatment is carried out at temperatures from 70 to 150° C.

32. The method for preparing a builder composition of claim 8, wherein the duration of the heat-treating is 2 to 120 minutes.

33. The method for preparing a builder composition of claim 8, wherein the duration of the heat treating is 10 to 120 minutes.

34. The method for preparing a builder composition of claim 13, wherein the builder composition is a powder having an average particle size of from 10 to 200 $\mu$m.

35. The method for preparing a builder composition of claim 13, wherein the builder composition is a powder having an average particle size of from 20 to 200 $\mu$m.

36. The method for preparing a builder composition of claim 14, wherein the builder composition is a granulate having an average particle size of 400 to 900 $\mu$m.

37. The laundry detergent or cleaner of claim 18, wherein the laundry detergent or cleaner comprises 5 to 50% by weight of bleaching systems.

38. A laundry detergent or cleaner comprising a) 0.5 to 99% by weight of the builder composition prepared according to the method of claim 1;

b) 0.5 to 80% by weight of cobuilders;

c) 1 to 50% by weight of interface-active substances;

d) 1 to 70% by weight of bleaching systems;

e) 0.5 to 80% by weight of pH regulators; and f) up to 100% by weight of further customary ingredients.

39. A laundry detergent or cleaner comprising a) 0.5 to 99% by weight of the builder composition prepared according to the method of claim 1;

b) 0 to 80% by weight of cobuilders;

c) 0 to 80% by weight of interface-active substances;

d) 0 to 70% by weight of bleaching systems;

e) 0 to 80% by weight of pH regulators; and f) up to 100% by weight of further customary ingredients.

* * * * *